United States Patent [19]

Schmidt et al.

[11] 3,970,489

[45] July 20, 1976

[54] CORRUGATOR CONTROL SYSTEM

[75] Inventors: Robert W. Schmidt, Oak Lawn; John R. Gallet, Hickory Hills; Thomas L. Czyz, Palos Hills, all of Ill.

[73] Assignee: Copar Corporation, Oak Lawn, Ill.

[22] Filed: July 14, 1975

[21] Appl. No.: 595,769

Related U.S. Application Data

[63] Continuation-in-part of Ser. No. 445,579, Feb. 25, 1974, abandoned.

[52] U.S. Cl. ..... 156/64; 156/351; 156/361; 156/378

[51] Int. Cl.[2] ..... B65H 25/00

[58] Field of Search ..... 156/351, 361, 378, 64, 156/205, 210, 470–473; 226/24, 26, 30, 40, 42, 45

[56] References Cited

UNITED STATES PATENTS

| | | | |
|---|---|---|---|
| 3,411,388 | 11/1968 | Rappaport | 156/64 X |
| 3,539,085 | 11/1970 | Anderson et al. | 226/42 X |
| 3,552,308 | 1/1971 | Minehart | 226/42 X |

*Primary Examiner*—David A. Simmons
*Attorney, Agent, or Firm*—Kinzer, Plyer, Dorn & McEachran

[57] ABSTRACT

A system for controlling, in a corrugating operation, the amount of single face material in a storage area ahead of the double face operation, includes means for sensing the difference between single face and double face drive speeds, and for providing a signal proportional to that difference; means for sensing the amount of single face material entering and leaving the storage area and means for providing a signal proportional to the difference therebetween; means for sensing the speed of material moving adjacent the storage area input and means for sensing the speed of material moving adjacent the storage area output and means for comparing said speeds and for applying the comparison to said material comparison signal; and control means for the single face drive utilizing the speed and material proportional signals as the inputs therefor.

19 Claims, 4 Drawing Figures

CORRUGATOR CONTROL SYSTEM

SUMMARY OF THE INVENTION

This application is a continuation-in-part of copending application Ser. No. 445,579 filed Feb. 25, 1974, now abandoned.

The present invention relates to corrugator control means and in particular to a means for controlling the amount of single face material in a storage area or bridge between the single face operation and the double face operation.

Another purpose is a control system of the type described which regulates the amount of stored single face material in the bridge and maintains the amount of material in the bridge at a predetermined level.

Another purpose is a control system of the type described which senses the amount of material moving into the storage area and the amount of material leaving the storage area and provides a signal proportional to the difference therebetween.

Another purpose is a control system of the type described which compares the speed of moving material in the bridge, adjacent the bridge input, with the speed of moving material in the bridge, adjacent the bridge output, and utilizes the comparison therebetween to maintain a predetermined level of material within the bridge.

Another purpose is a control system of the type described including means for detecting the amount of material in the bridge.

Another purpose is a control system of the type described utilizing a wetted single face area for determining the amount of material within the bridge.

Another purpose is a control system of the type described which utilizes signals representative of material moving into the storage area and material leaving the storage area to provide signals representative of the speed of the double face drive and single face drive.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
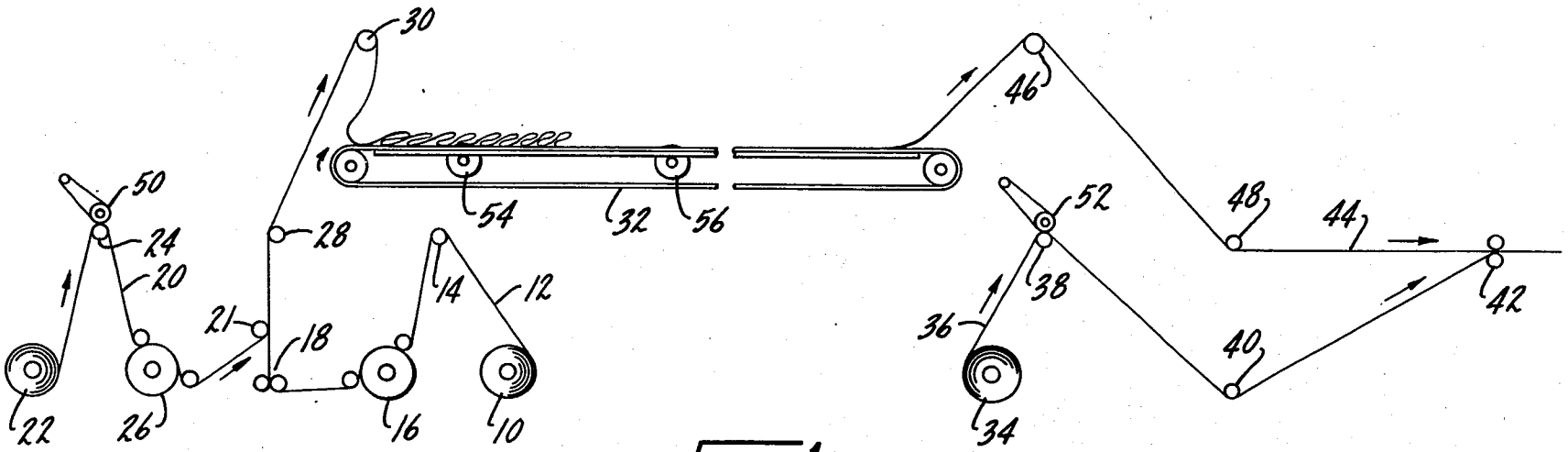
FIG. 1 is a diagrammatic illustration of a portion of a corrugating system.

Corrugated board used in the manufacture of corrugated boxes is made up of three paper sheets. The two outer sheets are called liners, and the corrugated center sheet is called the medium.

In manufacturing the board, the corrugated medium is made by running paper through corrugating rolls, after which glue is applied to the tips of the corrugations and a liner is joined to one side of the corrugated medium. The combination of one liner and the corrugated medium is referred to in the industry as "single face". In order to allow time for drying and curing of the glue, the single face, which is still flexible in the machine direction, is dropped onto a slow moving belt or storage area called a bridge. Material is removed from the bridge by the double facer, after which glue is applied to the exposed tips of the corrugated medium and the second liner is joined to form the well known corrugated product. After both liners have been applied, the material is passed through a double backer, which consists of a drier and a pull roll, and from there to the cut-off knives to be cut into appropriate lengths for box manufacture.

In order to avoid the necessity of stopping the entire machine each time either liner or the corrugated medium rolls must be spliced in, the double face section and the single face section each have independent drives. The double face speed is controlled by an operator at the cut-off end of the machine and the single face drive is controlled by a single facer operator. The bridge described above is the storage area between the single face drive and the double face drive.

The speed of the double facer is determined by the convenience in removing cut sheets and to control quality. The speed of the single face is determined by the single face operator in such a manner as to maintain the desired amount of footage in the bridge. The speed of the belt forming the bridge may vary from one-third of single face material speed to one-fifteenth of single face material speed. As the double facer speed is increased over the speed of the single facer, the lapped material stored in the bridge is reduced in footage and as the speed of the double facer is reduced below that of the single face operation, the lapped or festooned material will accumulate in the bridge. Thus, the single face operator maintains the desired footage within the bridge in order to prevent any snapping of material as the speed of the double face operation varies.

In the past it has been the practice of the single face operator to load the bridge up to its maximum amount of lapped material. Unfortunately, this has a tendency to cause uneven drying and unusual warp problems in the finished board.

One of the primary purposes of having the speed of the single facer and the double facer independent and for providing a variable storage in the bridge is that when one of the expiring rolls of the single face liner or the corrugated medium approaches the end of its roll, the single face operator increases the speed of the single face production over that of the double facer and stores several hundred feet of single face in the bridge, following which he can slow the machine sufficiently to splice in a new roll without running out of single face in the bridge, thereby causing the double facer end of the machine to stop and wait for the splice. However, during this period of time the undesirable excessive amount of single face in the bridge must be tolerated, even though it produces some small amount of warp.

It has been determined that warp problems will be minimized if a minimum amount of material is retained in the bridge so that single face is essentially being manufactured at the same rate at all times as it is being combined with double faced liner. Thus, if double face speed increases or decreases, it should be matched by an increase or decrease in the speed of the single facer, and a fairly constant length of material should be retained in the bridge.

Recent experiments have proven that to minimize warp, it is desirable to hold approximately 25–50 lineal feet of lapped material in the bridge. Since the corrugator normally runs at speeds of 400–500 feet per minute, it is obvious that with a 10 foot speed differential, 25 feet of stored material only provides 2½ minutes leeway. As the problem of maintaining this amount of material in the bridge at these speeds is too demanding a job for a single face operator, the present invention provides an automatic speed control for the single facer to automatically retain a given amount of material within the bridge. In addition, the control permits the addition of a certain amount of material to the bridge in preparation for a splice of an expiring liner or corrugated medium roll and then returns the bridge material to the predetermined level after the splice is completed. Also, the control period can provide for an automatic water spray valve turn-on during a splice cycle to offset the additional drying of the single face material when the speed of the single facer drops below that of the double facer.

In FIG. 1 a roll of corrugating medium is indicated at 10, with the medium 12 passing over spaced rolls 14 and 16 to corrugating rolls 18 where the medium is corrugated, after which it is combined at roll 21 with single face liner 20. The roll of single face liner is indicated at 22 with the single face liner passing over rolls 24 and 26 before it reaches the combining roll 21. The glue application rolls are omitted as they are not relevant. After the corrugated medium 12 and the single face liner 20 are combined, the material moves upwardly over a roll 28 and a roll 30 to the point where the material is lapped onto a moving belt 32. The belt 32 is what has been described as the bridge or storage area and the material will be deposited on the belt 32 at single face speed, as described.

A roll of liner material is indicated at 34, with the double face liner 36 passing over spaced rollers 38 and 40 to a point 42 where the double face liner 36 joins the single face 44. Again, glue application rolls are omitted as irrelevant. The single face 44 passes over rollers 46 and 48 after being removed from the right-hand end of the bridge 32.

Adjacent the roll 24 over which the single face material 20 is passing is a pulse generator 50 which provides a predetermined number of pulses per foot of single face liner, for example, 10 pulses per foot. In like manner, there is a pulse generator 52 adjacent double face liner roll 38 which provides a predetermined number of pulses per foot of double face liner, for example again 10 pulses per foot.

A first measuring wheel 54 is positioned near the input to the bridge 32 to determine the speed of material moving through the bridge at that point. Thus, wheel 54 will measure the speed of the material passing over it as the material is carried by belt 32. A second measuring wheel for the bridge 32 is indicated at 56 and it is spaced a predetermined distance from wheel 54 and will measure the speed of the material on the bridge at this point. Thus, if the bridge transport belt is traveling at a predetermined speed relative to single face speed, for example one-seventh of single face speed, and wheel 54 is measuring material moving at one-seventh of single face speed, then wheel 54 will be measuring moving lapped material. On the other hand, if wheel 56 is measuring material moving at the same speed as the single face liner or as the double face liner, then obviously there will be no lapped material at this point on the bridge.

Figure 2:
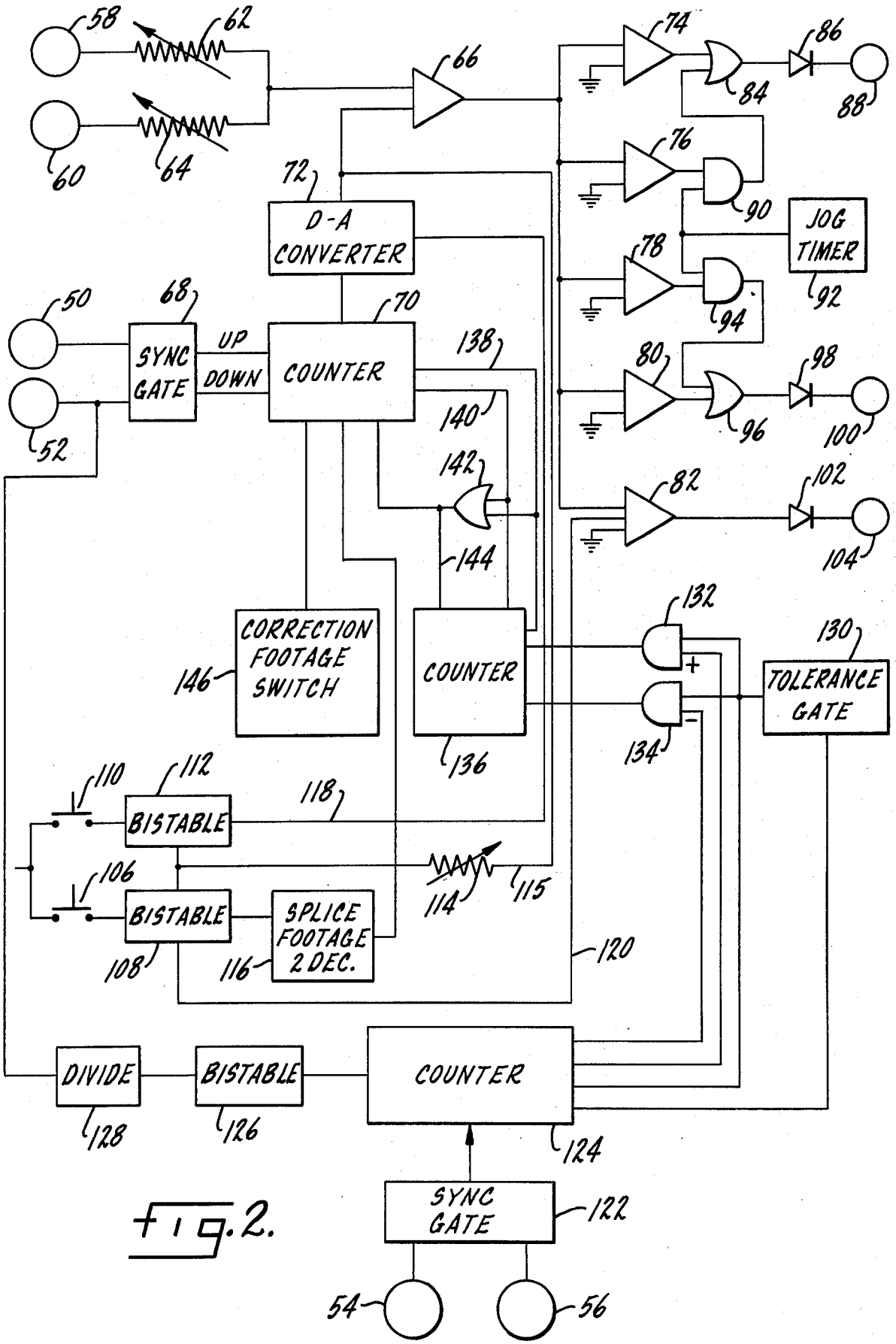
FIG. 2 is a block diagram of the control system described herein.

In FIG. 2 a pair of tachometers are indicated at 58 and 60, with tachometer 58 sensing the speed of the single facer drive and tachometer 60 sensing the speed of the double facer drive. The output of the tachometers 58 and 60 are each connected through potentiometers 62 and 64 respectively to the input of an operational amplifier 66. Thus, the input to amplifier 66 from the tachometers will be a voltage whose polarity and amplitude will vary in accordance with the difference between the single facer drive speed and the double facer drive speed. If the drive speeds are identical or equal, there will be no input voltage to operational amplifier 66.

Pulse generators 50 and 52 are each connected in FIG. 2 to a sync gate 68 with the output of the sync gate being connected to a four-decade up-down counter 70. As indicated before, each of the pulse generators 50 and 52 provide a predetermined number of output pulses per foot of material passing by the generators. Sync gate 68 merely insures that there will be pulses passed to the counter even if the pulses from the two generators are coincident. Counter 70 is connected through a digital-to-analog converter 72, with the output of converter 72 being connected to operational amplifier 66. In operation, counts from one pulse generator will be plus counts, whereas, counts from the other generator will be minus counts, with the result that there should be a zero output count from the counter 70, assuming that the same amount of material is moving past each of the pulse generators. Either a negative or positive count at the output of counter 70 will provide a negative or positive voltage at the output of converter 72 for use in changing the single face drive speed.

The output from operational amplifier 66 is connected to five different Schmitt trigger circuits indicated at 74, 76, 78, 80 and 82 respectively. The output from Schmitt trigger 74 is connected to an OR gate 84 with the output of OR gate 84 being connected through a relay drive amplifier 86 to a relay coil 88. The output from trigger circuit 76 is connected to an AND gate 90 whose output is connected to OR gate 84. A jog timer 92 is connected to AND gate 90 and to an AND gate 94 which receives an input from trigger circuit 78. The output from AND gate 94 is connected to an OR gate 96 which also receives an input from trigger circuit 80. The output from OR gate 96 is connected to a relay driver amplifier 98 and to a relay coil 100. Schmitt trigger circuit 82 is connected directly to a relay driver amplifier 102 and then to a relay coil 104.

The speed of the single facer drive motor is adjusted by a motor driven rheostat. The operator normally actuates the motor driven rheostat by pressing either an increase or a decrease button. Relay coils 88 and 100 control contacts which parallel these buttons and hence current flow through either one of these coils will cause the motor driven rheostat to effectively increase or decrease single facer drive motor speed.

In operation, assuming that single face speed and double face speed are the same, there will be no differential or proportional output from tachometers 58 and 60 and thus no input to the operational amplifier from the tachometers. Also, assuming that the material travel is the same, there will be no input from counter 70 and digital-to-analog converter 72 to the operational amplifier 66 and thus neither coil 88 nor 100 will function to change the speed of the single facer drive motor. If, however, single face material is being driven at a greater speed than the double face liner, there will be a proportional input to amplifier 66, and assuming the voltage output from amplifier 66 is above a predetermined level, for example 2½ volts, then Schmitt trigger 74, which is voltage sensitive, willl provide a signal through OR gate 84 to cause relay coil 88 to operate in a manner to continuously drive the motor driven rheostat to change the speed of the single facer drive. If the difference in voltage at the output of amplifier 66 is below 2½ volts, but above 0.25 volt, it will cause Schmitt trigger 76 to provide an output to AND gate. Thus, every time jog timer 92 provides an output signal, which will occur in a predetermined time sequence, there will be an output from AND gate 90 to OR gate 84 and thus current through coil 88 for a predetermined period consistent with the timing of jog timer 92. Thus, when there is a smaller difference between single facer drive speed and double facer drive speed, the motor driven rheostat will jog or slowly move the single facer drive until there is coincidence between the two speeds.

When the speed differential is in the opposite direction, for example single facer drive speed below that of the double facer speed, then Schmitt triggers 78 and 80 will be effective to reverse the direction of the motor driven rheostat controlling the single facer drive speed in the same manner as described.

Tachometers 58 and 60 and pulse generators 50 and 52 both provide information relative to differences in movement between single face material and double face liner. However, since the tachometers may not provide a linear voltage output over this entire speed range, it is necessary to combine their information with that from the pulse generators, which, by means of summing counter 70 provide correction for accumulation or loss of material due to tachometer errors.

When the entire system is initially put into operation, the operator adjusts the speed of the single facer manually until the amount of single face he desires is in the bridge. He will then press a set button on the overall control which sets counter 70 to zero. Thereafter, the control will function to adjust single facer drive motor speed as necessary to maintain this particular footage within the bridge.

As indicated above, at times it is necessary to speed up the single face operation to store sufficient material in the bridge to provide splicing time. A prepare-to-splice switch is indicated at 106 and is connected to a bistable circuit 108. A splice-complete switch 110 is connected to a second bistable 112. Bistables 108 and 112 are connected to a splice footage speed adjust pot 114, which in turn is connected to the output side of digital-to-analog converter 72. A two-decade splice footage counter 116 is connected to the output of bistable 108 and provides an input for counter 70.

When it is desired to splice in a new roll of single face or corrugated medium, the prepare-to-splice switch 106 is closed, causing both bistables 108 and 112 to change conditions. When bistable 112 changes condition, it places an inhibit signal on digital-to-analog converter 72 through line 118. At the same time an alternate signal is supplied operational amplifier 66 through line 115, with the potential supplied being determined by splice footage speed adjust pot 114. Thus, the single facer drive will have an increased speed until a predetermined amount of material has been placed in the bridge as determined by coincidence between counter 116 and counter 70. At such time as the desired additional material is in the bridge, the single facer drive motor will be returned to a speed matched with that of the double facer drive. To make the splice, the operator slows down the single facer drive. After completion of the splice he operates switch 110, which returns the bistables to their original conditions so that the system may then be controlled in the normal manner.

During the splicing operation it may be desirable to activate a water spray to prevent the material within the bridge from becoming overly dry.

There is a direct connection from bistable 108, through line 120, to Schmitt trigger 82. Thus, assuming this particular option is included in the overall control system, at such time as the splice is to take place, and when the splice button 106 is closed, Schmitt trigger 82, through relay driver amplifier 102, will provide a signal for relay coil 104 which will cause water to be sprayed on the single face material during the splice cycle.

Measuring wheels 54 and 56, measuring the amount of material in the bridge adjacent its input and at a predetermined distance therefrom, are each connected to a sync gate 122 which functions to permit pulses to be read even though they are coincident, with sync gate 122 being connected to a two-decade up and down counter 124. Counter 124 is connected through a bistable 126 and a divide-by-100 circuit 128 to the output of the double facer pulse generator 52.

The output from counter 124 is connected to a tolerance gate 130 which in turn has a common output for AND gates 132 and 134. AND gates 132 and 134 also receive inputs from counter 124. AND gates 132 and 134 are connected to a one-decade counter 136 which has outputs on lines 138 and 140 to counter 70, with lines 138 and 140 also being connected to an OR gate 142. The output of OR gate 142 is connected to counter 70 and an additional output from counter 136 on line 144 is connected to counter 70. The circuit is completed by a correction footage two-decade counter 146.

As indicated previously, the speed of belt 32 in the bridge is substantially less than that of the single face material and double facer material. Assuming bridge speed is one-seventh of that of the single facer material, the excess material or lapped material on the bridge will be stored at a rate of approximately seven feet of material to one foot of bridge space. If it is desired that sensing wheel 54 sense lapped material and sensing wheel 56 sense material moving at double facer speed, then wheel 56 will move at seven times the speed of wheel 54. On the other hand, if both wheels are covered by lapped material, or neither wheel is covered by lapped material, then both wheels will be moving at the same speed. Assuming that the wheels 54 and 56 are each two feet in circumference and each produce 10 pulses per revolution, then if both wheels were being driven by lapped material, each would produce seven pulses or a total of 14 pulses. If wheel 54 were covered by lapped material, but wheel 56 was only covered by material moving at double facer speed, wheel 54 would produce seven pulses and wheel 56 would produce 50 pulses or a total of 57 pulses. If neither wheel was covered by lapped material, but each was registering material moving at single face and double face speed, there would be a total of 100 pulses produced by the two wheels.

Since the desirable result is to have wheel 54 covered by lapped material and wheel 56 covered by a single layer of material moving at double facer speed, counter 124 is preset for 57 counts. If material is stored in the bridge in the desired manner, wheels 54 and 56 will reduce the count to zero in the sensing or sampling interval. In this connection, the sensing interval is determined by divide circuit 128 and bistable 126 which provides for a sampling or sensing interval for every 20 feet of material leaving. Bistable 126 controls the count and display interval of counter 124. Counter 124, therefore, senses information from wheels 54 and 56 via sync gate 122 for an interval equivalent to 10 feet of material exiting the bridge and displays for an interval equivalent to 10 feet of material exiting the bridge. Counter 124 is automatically reset to −57 at the end of the display period. If the situation is as described and wheel 54 is covered by lapped material and wheel 56 is not, the count of 57 stored in counter 124 will be counted down to zero in the sampling interval. On the other hand, if both wheels are covered by lapped material, or neither wheel is covered by lapped material, or for a portion of the counting interval both wheels or neither wheel is covered by lapped material, then the 57 count will not be reduced to zero. If the count from both wheels exceeds 57, the counter will first count down to zero, then reverse and count up. This provides for use of a single preset amount.

In the example cited, the maximum error count is 43 in either a plus or minus direction, depending upon whether there is lapped material over both wheels or no lapped material over either wheel. The tolerance gate 130 determines what particular tolerance can be accepted by the system in the nature of excessive bridge material or a deficiency in bridge material and yet still have satisfactory operating conditions. If, for example, the tolerance gate is set for 20 counts in either the plus or minus direction, every time the tolerance setting is exceeded, there will be an output to AND gates 132 or 134, depending upon whether the excess is in a plus or minus direction. Thus, an output from counter 124 to either one of the AND gates and an output from the tolerance gate 130 will provide an output from either AND gate 132 or AND gate 134 to counter 136, depending upon whether the remaining count is a plus or a minus count. After there have been three successive inputs to counter 136 caused by an excessive retained count in counter 124 in the same direction, there will be an output from counter 136 to counter 70 either in the plus or minus direction and a direct output to open counter 70 to permit the introduction of a predetermined count from two-decade switch 146. Thus, if it is determined that a tolerance of 20 counts can be accepted as a workable error, if this tolerance is exceeded for three successive sampling intervals, after the third interval, a count equal to the tolerance, 20 counts, will be automatically placed in counter 70 by switch 146 as controlled by counter 136 and OR gate 142. This inclusion in the counter of a predetermined count in either the plus or minus direction will automatically cause a corrective voltage in the right direction to be placed at the input of amplifier 66, which will have the end result of causing the single facer drive motor to move in the proper direction and return the amount of lapped material in the bridge to its proper level. Thus, an inclusion of 20 positive counts will automatically cause the drive motor for the single facer to be moved in the direction to compensate for an excess of material in the bridge, thus causing the single facer drive motor to slow down. Once stability has again been reached, i.e. the appropriate amount of material in the bridge as sensed by wheels 54 and 56, the single facer drive motor will automatically return to its normal speed.

The above-described compensation system is desirable because there is a tendency over long periods to accumulate or lose material in the bridge due to small measurement errors and dimensional changes in the material. The compensation system will periodically correct these errors, as sensed by wheels 54 and 56.

Figure 3:
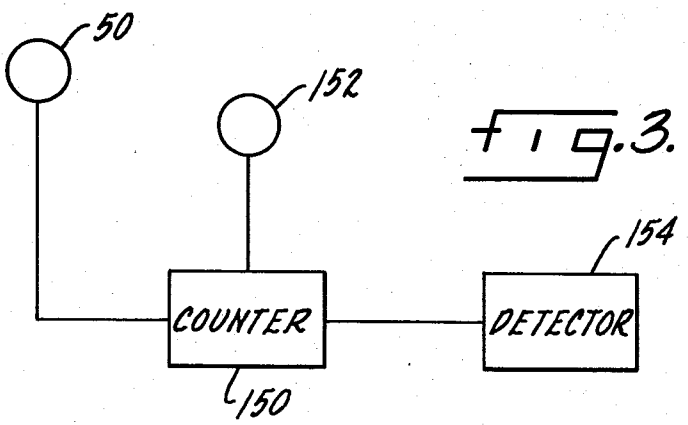
FIG. 3 is a partial block diagram of a modification of the invention.

As an accurate means for determining how much material is within the bridge at a given time, which means can then be used as a further compensating control of the single facer drive motor, a counter 150 (FIG. 3) is reset to zero whenever a water valve 152 is activated to spray water on a predetermined area of single face material. The spray device will be located at roll 30. Counter 150 will accumulate counts until it is stopped by a detector 154 adjacent the bridge output. The detector 154, which will be located at roll 46, may consist of two electrically insulated wheels, side by side, connected to a resistance measuring circuit which detects the wetted spot of single face. As an accurate measurement of the length of the bridge is known, and as the detection of the wetted spot gives the total amount of material put into the bridge, the difference provides the excess of lapped stock which gives an indication of how much material is stored in the bridge.

Figure 4:
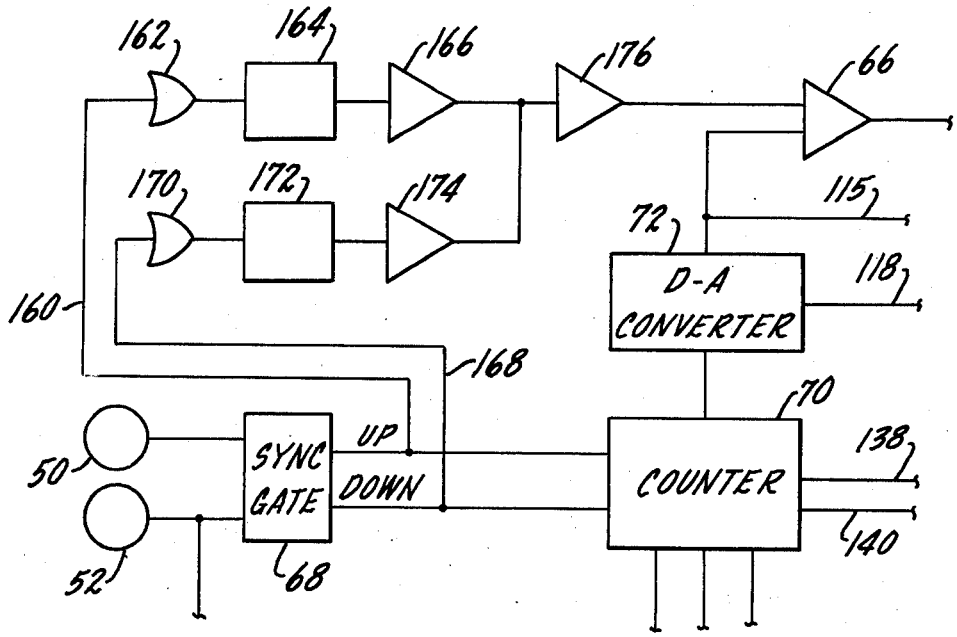
FIG. 4 is a partial block diagram of a further modification of the invention.

In the modification of FIG. 4, only a portion of the overall circuit of FIG. 2 has been shown with like parts being given identical numbers. In essence, tachometers 58 and 60 and their associated variable resistors 62 and 64 have been eliminated and signals representative of single face drive speed and double face drive speed have been provided by pulse generators 50 and 52. It should be understood that all of the remaining circuitry of FIG. 2 would normally be present and FIG. 4 only shows the modification.

One output of sync gate 68 provides a signal representative of the pulses from pulse generator 50. Thus, line 160 is connected to one output of sync gate 68 and is in turn connected to a NOR gate 162 which functions as a shaping circuit. NOR gate 162 is connected to a timer 164 which provides an output of a constant duration pulse to an inverting amplifier 166. The other output of sync gate 68 is connected through a line 168 to a shaping NOR gate 170 which in turn is connected through an adjustable timer 172 to non-inverting amplifier 174. Amplifiers 166 and 174 are connected to a fixed gain amplifier 176 whose output replaces the combined output of tachometers 58 and 60 in the overall circuit of FIG. 2.

Timers 164 and 172 provide constant duration pulses, with the timer 172 being adjustable to permit factory adjustment so that the duration of the pulse outputs from the timers are identical. Since amplifier 166 is an inverting amplifier and amplifier 174 is a non-inverting amplifier, the output of the two amplifiers will have opposite polarity as applied to amplifier 176. Thus, if the single face liner and double face liner are moving at identical speeds, there will be zero output from amplifier 176 to operational amplifier 66. If the single face liner is moving faster than the double face liner, then the input from amplifier 176 will be positive and will cause the single face drive to slow down by means of the above-described circuitry. If the single face liner is moving at a slower rate of speed than the double face liner, then the opposite result will take place.

The modification of FIG. 4 recognizes the fact that it is not always necessary to have motor tachometers to determine the drive speed of the single face drive and the double face drive. These speeds may be provided by the pulse trains representative of movement of the liner which does in fact represent speed of the drive.

Whereas the preferred form of the invention has been shown and described herein, it should be realized that there may be many modifications, substitutions and alterations thereto.

The embodiments of the invention in which an exclusive property or privilege is claimed are defined as follows:

1. A system for controlling the amount of single face material in a storage area ahead of the double face operation including:

means for providing a signal representative of the difference between single face drive speed and double face drive speed, means for sensing the amount of single face material moving into said storage area, means for sensing the amount of single face material leaving said storage area, comparison means connected to said sensing means for providing an output signal proportional to their difference, means for sensing the speed of material moving adjacent the storage area input and means for sensing the speed of material moving adjacent the storage area output, means for comparing said storage area input and output material speeds, and means for applying the comparison from said storage area input and output speeds to said material comparison means, speed control means for automatically increasing or decreasing the speed of said single face drive to maintain a predetermined level of single face material in said storage area, said signal representative of the speed difference and said material comparison proportional output signal being connected to said speed control means and providing the input signals therefor.

2. The system of claim 1 further characterized in that said material sensing means includes pulse generating means for sensing the amount of single face material moving into the storage area and pulse generating means for sensing the amount of single face material leaving said storage area.

3. The system of claim 2 further characterized in that said pulse comparison means includes a counting circuit, with pulses from the pulse generating means sensing the single face material moving into the storage area causing said counting circuit to count in one direction and pulses from the pulse generating means sensing the single face material leaving said storage area causing said counter to count in the opposite direction.

4. The system of claim 3 further characterized by and including a digital-to-analog converter connected in said counting circuit, with the output of said converter being connected to said speed control means.

5. The system of claim 4 further characterized in that said speed control means includes an operational amplifier, said digital-to-analog converter being connected to said operational amplifier and providing one input therefor.

6. The system of claim 5 further characterized in that said speed sensing means includes tachometers, each of which are connected to said operational amplifier.

7. The system of claim 1 further characterized by and including tolerance means connected to said applying means and material comparison means, said applying means only applying the comparison from said storage area input and output material speeds when the comparison exceeds the setting of said tolerance means.

8. The system of claim 1 further characterized in that said storage area comparison means includes a counting circuit, a tolerance gate connected to said counting circuit and to the means for applying said comparison.

9. The system of claim 8 further characterized in that said material movement comparison means includes a counting circuit, said applying means includes pulse generating means connected to said material movement comparison means and controlled by said tolerance gate.

10. The system of claim 9 further characterized in that said last-named pulse generating means is programmed to provide the same predetermined count to said pulse comparison means as is the count level of said tolerance gate.

11. The system of claim 1 further characterized by and including counting means for sensing the amount of material passing into said storage area in a given period of time.

12. The system of claim 11 further characterized by and including means for applying liquid to an area of said single face material as it enters the storage area, and means for detecting the location of said wetted area adjacent the output of said storage area.

13. The system of claim 12 further characterized by and including means for starting said counting means at the application of liquid to said single face material and means for stopping said counting means at the detection of the wetted single face material.

14. The system of claim 1 further characterized by and including means for disabling said material comparison means for a predetermined period.

15. The system of claim 1 further characterized in that the means for sensing the amount of single face material moving into said storage area and the means for sensing the amount of single face material leaving said storage area provide the signals utilized in said means for providing a signal representative of the difference between single face drive speed and double face drive speed.

16. A method of controlling the amount of single face material in a storage area ahead of the double face operation including the steps of:

sensing the difference between single face drive speed and double face drive speed and providing a signal proportional to that difference, sensing the amount of single face material moving into the storage area and sensing the amount of single face material leaving the storage area and providing a signal proportional to their difference, measuring the speed of single face material adjacent the input to the storage area and measuring the speed of single face material adjacent the output of the storage area, comparing said speeds and applying the resultant comparison to the signal proportional to the difference between material entering and leaving the storage area, and using the signal proportional to the difference in single face and double face drive speeds and the material proportional signal to automatically increase or decrease the speed of the single face drive to maintain a predetermined level of single face material in the storage area.

17. The method of claim 16 further characterized by the steps of applying said storage area speed comparison against a predetermined level, and adjusting said single face drive whenever said predetermined level is exceeded a given number of times.

18. The method of claim 16 further characterized by and including the step of periodically measuring the amount of material within the storage area.

19. The method of claim 18 further characterized in that said measuring step includes the step of applying liquid to said single face as it enters the storage area and subsequently detecting the wetted area.

* * * * *